US008998015B2

(12) United States Patent
Williams et al.

(10) Patent No.: US 8,998,015 B2
(45) Date of Patent: Apr. 7, 2015

(54) CAN END

(75) Inventors: Andrew Richard Williams, Oxfordshire (GB); Brendan Keane, Deerfield, IL (US); Brian Fields, Lemont, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 266 days.

(21) Appl. No.: 13/265,689

(22) PCT Filed: Apr. 22, 2010

(86) PCT No.: PCT/EP2010/055366

§ 371 (c)(1), (2), (4) Date: Oct. 21, 2011

(87) PCT Pub. No.: WO2010/122111

PCT Pub. Date: Oct. 28, 2010

(65) Prior Publication Data

US 2012/0043325 A1 Feb. 23, 2012

(30) Foreign Application Priority Data

Apr. 23, 2009 (EP) ..... 09158566

(51) Int. Cl.

*B65D 17/34* (2006.01)
*B65D 17/00* (2006.01)
*B65D 79/00* (2006.01)

(52) U.S. Cl.

CPC ..... *B65D 17/165* (2013.01); *B65D 17/163* (2013.01); *B65D 79/005* (2013.01); *B65D 2517/0013* (2013.01); *B65D 2517/007* (2013.01); *B65D 2517/0076* (2013.01); *B65D 2517/0089* (2013.01)

(58) Field of Classification Search

CPC ..... B65D 17/165; B65D 17/163; B65D 2517/0073; B65D 2517/0079; B65D 2517/0014; B65D 2517/0076

USPC ..... 220/269, 270, 906, 272, 273, 258.2, 220/608, 609

See application file for complete search history.

(56) References Cited

U.S. PATENT DOCUMENTS

| | | | | |
|---|---|---|---|---|
| 3,544,025 | A | 12/1970 | La Croce | |
| 3,938,696 | A | 2/1976 | Herbst | |
| 4,039,101 | A * | 8/1977 | Wells | 220/269 |
| 4,051,976 | A * | 10/1977 | Perry | 220/269 |
| 4,266,688 | A * | 5/1981 | Reid | 220/273 |
| 5,307,947 | A * | 5/1994 | Moen et al. | 220/266 |
| 5,335,808 | A * | 8/1994 | Lee | 220/269 |
| 5,397,014 | A * | 3/1995 | Aydt | 220/269 |

(Continued)

FOREIGN PATENT DOCUMENTS

| | | |
|---|---|---|
| EP | 2075199 | 7/2009 |
| JP | 2003-054549 | 2/2003 |

*Primary Examiner* — Robert J Hicks
*Assistant Examiner* — Shawn M Braden
(74) *Attorney, Agent, or Firm* — Baker & Hostetler LLP

(57) ABSTRACT

The invention is an easily openable (1) can end which provides an improved way of providing finger access under the tab for a consumer. A can end is disclosed having an end pane (2)1, the end panel including a moveable portion (7) on which the tab is mounted. Finger access is provided by the moveable portion being moveable from a predetermined first state to a predetermined second state to thereby displace the handle of the tab away from the end panel and define a gap between the handle of the tab and the end panel suitable for finger access by a user.

27 Claims, 5 Drawing Sheets

(56) References Cited

U.S. PATENT DOCUMENTS

| | | | | |
|---|---|---|---|---|
| 5,413,241 | A | 5/1995 | Yeh | |
| 5,655,678 | A * | 8/1997 | Kobayashi | 220/269 |
| 5,813,561 | A * | 9/1998 | Chang et al. | 220/269 |
| 5,947,317 | A | 9/1999 | Hall | |
| 6,427,861 | B1 * | 8/2002 | Cho | 220/269 |
| 7,168,586 | B2 * | 1/2007 | Jeon | 220/269 |
| 2004/0065663 | A1 * | 4/2004 | Turner et al. | 220/254.1 |
| 2005/0098561 | A1 * | 5/2005 | Schwoebel | 220/258.1 |
| 2007/0108209 | A1 * | 5/2007 | Jeon | 220/269 |
| 2008/0173646 | A1 * | 7/2008 | Wang | 220/269 |
| 2010/0089923 | A1 * | 4/2010 | Yang | 220/270 |
| 2011/0308202 | A1 * | 12/2011 | Hall | 53/467 |

* cited by examiner

CAN END

CROSS-REFERENCE TO RELATED APPLICATIONS

This application is the National Stage of International Application No. PCT/EP2010/055366, filed Apr. 22, 2010, which claims the benefit of EP application number 09158566.1, filed Apr. 23, 2009, the disclosures of which are incorporated herein by reference in their entirety.

TECHNICAL FIELD

This invention relates to an easy open can end with an improved means of opening. The invention is particularly suitable for use on metal packaging for food and beverage products. Variants of the invention are disclosed which are particularly suitable for containers subject to either negative pressure or positive internal pressure.

BACKGROUND ART

Easy-open can ends are well known in the field of can manufacture—for example, that disclosed in FIGS. 4 & 5 of U.S. Pat. No. 5,413,241 (YEH HSI-SHOU) 9 May 1995. The can end disclosed is provided with an end panel having a score line defining a prearranged opening area to provide a "full-aperture" end. By "full aperture" is meant having the prearranged opening area covering virtually all of the area of the end panel. A tab is secured to the end panel, with the nose of the tab located adjacent the score line. To avoid interference between adjacent can ends during their transportation, the handle of the tab is located tight against the outer surface of the end panel. It would remain in this position after attachment of the can end to a can body—as is normal practice for virtually all current easy-open can ends. However, this presents a problem for a consumer wishing to open the can because they must first prise the handle of the tab away from the surface of the end panel in order to lift the tab to rupture the score line. The lack of clearance between the tab handle and the end panel makes this a difficult task, especially for those with weak hands.

U.S. Pat. No. 7,168,586 B (CROWN PACKAGING TECHNOLOGY, INC) 30 Jan. 2007 provides one solution to the above problem of tab access. U.S. Pat. No. 7,168,586B2 discloses a "full-aperture" easy-open can end with a score line defining a prearranged opening area. The can end disclosed has a collapsible protrusion under the handle of the tab, the collapsible protrusion deformable between two states. Initially, the collapsible protrusion protrudes upward from the can end to define a minimal (or zero) gap between the handle of the tab and the protrusion. This provides efficient stackability of one can end upon another for storage/transportation purposes and avoids adjacent can ends becoming caught between the handle of the tab and the can end. The protrusion is deformable downwards from the tab into a second state, to define a concave finger well under the handle of the tab sufficient for a user to insert their finger.

However, there are several problems with the protrusion shown and described in U.S. Pat. No. 7,168,586B2:

The invention of U.S. Pat. No. 7,168,586B2 is not suitable for large diameter "full-aperture" can ends. For the purpose of this application, large diameter means larger than about 4 inches). The reason for this is that to preserve easy stackability without having to index each can end relative to another, the protrusion must be centrally located on the can end. However, for full-aperture can ends, the tab must be situated near the periphery of the can end in order for the nose of the tab to be adjacent the score line for opening. These two requirements increasingly conflict with each other for larger diameter can ends. Consequently, as can end diameter increases, a far deeper protrusion is required to provide a given amount of finger access under the handle of the tab. Ultimately, it becomes impossible to form a sufficiently deep protrusion under the tab to enable finger access.

The collapsible protrusion of U.S. Pat. No. 7,168,586B2 has to occupy a substantial area of the can end to define a finger well of sufficient depth to permit a consumer to insert their finger under the tab.

Further, providing an increase in tab access when using such a finger well under the handle of the tab typically necessitates either or both of:

i. using a finger well which occupies a greater area of the can end; or ii. a greater amount of stretching of the metal to form the collapsible protrusion.

Additionally, the protrusion of U.S. Pat. No. 7,168,586B2 is a non-planar surface, which can present a difficult surface on which to print logos, images or instructions.

There is therefore a need for an improved can end, which can be transformed from first to second states to provide improved tab access.

DISCLOSURE OF INVENTION

Accordingly, there is provided an easily openable can end provided with an end panel, a score line formed in the end panel to define a prearranged opening area, a tab for severing the score line, the tab having a nose and a handle, characterised in that the end panel comprises a moveable portion on which the tab is mounted, the moveable portion adapted to be moveable from a predetermined first state to a predetermined second state to thereby displace the handle of the tab away from the end panel and define a gap between the handle of the tab and the end panel suitable for finger access by a user.

The can end of the invention uses a different mechanism to that of U.S. Pat. No. 7,168,586B2 to provide finger access under the handle of the tab. The present invention uses deformation of that part of the end panel on which the tab is mounted to define a finger access gap under the handle of the tab, without the need for a dedicated finger well under the handle of the tab itself.

A consequence of the invention is that it is possible to confine much of the area of the moveable portion so that it is under the tab itself. Therefore, the present invention allows much of the remainder of the end panel to remain generally planar (with the exception perhaps of some strengthening beads or panelling), thereby providing an easier surface on which to print instructions, logos and/or other text/graphics (in contrast to that of U.S. Pat. No. 7,168,586B2).

Further, because tab access is provided by displacement of the mounting location for the tab (i.e. the moveable portion), the amount of finger access that can be provided is independent of can end diameter for "full aperture" can ends, i.e. the size of can end does not affect ability of the invention to provide finger access under the tab (in contrast to U.S. Pat. No. 7,168,586B2).

The first state is most suitable for transportation of the can ends, because it would have (relative to the second state), minimal or zero gap between the tab handle and the end panel. Consequently, of the two states, it would typically provide the most efficient stacking for the can ends.

The invention may be enabled by the moveable portion being in the form of a "mono-stable" panel, i.e. having one defined stable (or default) state. This stable (or default) state is either of the predetermined first or second states. However, for the purpose of ensuring efficient stacking of the can ends, it is preferred that the stable (or default) state is the first state. The mono-stable construction requires a force to be applied to transform the moveable portion from the stable (or default) state to the other state—with removal of the force causing the moveable portion to revert to the stable (or default) state.

Preferably however, the moveable portion comprises a "bistable panel". By a bistable panel is meant a panel having two defined stable states, with the application of a force required to cause the panel to change between the two states. The advantage of using a bistable panel for the invention is that once the panel is moved into its second state (i.e. the "finger-access" state), it would require the application of a force to cause it to revert into its first state. In the lack of any such force, a stable gap is maintained under the handle of the tab.

Preferably, the tab is mounted on the moveable portion such that in the first state the handle of the tab is biased against the end panel. This may be enabled by the tab including a resiliently formed tongue section, the tab mounted on the moveable portion via the tongue section to bias the handle of the tab against the end panel in the first state. Prior to their attachment to a container body, the can ends would typically be transported—as a stack, one can end upon another—with the moveable portion in this first state. Consequently, having the handle of the tab biased against the end panel has the advantage of resisting foreign objects or adjacent can ends becoming stuck or locked under the handle of the tab.

The can end is preferably made from metal, with steel, tinplate or aluminium being examples of many suitable materials.

The can end of the present invention is intended to be fastened to close an access opening of a container body. The can end may be fastened to the container body by any conventional process known in the field of metal packaging; for example, by double seaming.

In an especially preferred embodiment, the moveable portion is provided on a platform elevated relative to the remainder of the end panel such that in the first state, the lowermost point of the moveable portion does not extend below the lowermost plane of the can end, thereby enhancing stackability of the can end.

The present invention allows for the gap between the handle of the tab and the end panel being provided by a number of different mechanisms:

Mechanism 1

In one aspect of the invention, the transition from first to second states is by a generally downwards motion of the moveable portion. This is conveniently enabled by the moveable portion being formed such that:

i. in the first state, the moveable portion protrudes upwardly from the end panel; and ii. in the second state, the moveable portion protrudes downwardly from the end panel.

Conveniently, the moveable portion is formed as a generally upwardly projecting convex protrusion and a generally downwardly projecting concave protrusion in first and second states respectively. Preferably, the tab is mounted on an inclined region of the moveable portion such that when occupying the first "convex" state, the tab handle is inclined towards the end panel, with transformation to the second "concave" state inclining the tab handle upwardly away from the end panel to thereby provide the gap between the handle of the tab and the end panel suitable for finger access by a user. The inclination referred to is measured relative to the horizontal plane generally defined by the can end. This aspect of the invention takes advantage of the natural curvature that a convex/concave protrusion possesses and the full or partial reversal in inclination that it undergoes when changing between convex and concave states. Mounting the tab on the inclined region of the moveable portion, and the reversal in inclination that occurs on transformation from first "convex" to second "concave" states provides an efficient mechanism for displacing the tab and providing finger access under the tab. Summarising, mounting the tab in this manner means that for a tab of a given length, the invention requires a moveable portion of a smaller area than that of the finger well of U.S. Pat. No. 7,168,586B2 to provide the same gap under the handle of the tab.

The downwards motion may be initiated by pressing down with a person's finger; for example, by an end consumer of a filled container incorporating the can end. However, it is preferred that the moveable portion be in its downward "finger access state" before it reaches the consumer. Therefore, mechanical means may be used on a filled container to press the moveable portion downwards (e.g. using a punch or other mechanical means). Alternatively, negative pressure (i.e. vacuum) may be used to suck (or pull) down the moveable portion into the second state. Considering the example of containers for food products, the negative pressure may be achieved through fastening the can end to a container body filled with a heated product, with cooling of the product to ambient temperature naturally resulting in negative pressure within the sealed container. As the negative pressure would be sustained until the container is opened, this would permit a mono-stable panel to be used for the moveable portion.

Mechanism 2

In an alternative aspect of the invention, the transition from first to second states is by a generally upwards motion of the moveable portion. This is conveniently enabled by the moveable portion being formed such that:

i. in the first state, the moveable portion protrudes downwardly from the end panel; and ii. in the second state, the moveable portion protrudes upwardly from the end panel.

Conveniently, the moveable portion is formed as a generally downwardly projecting concave protrusion and a generally upwardly projecting convex protrusion in first and second states respectively. Preferably, the tab is mounted on an inclined region of the moveable portion such that when occupying the first "concave" state, the tab handle is inclined towards the end panel, with transformation to the second "convex" state inclining the tab handle upwardly away from the end panel to thereby provide the gap between the handle of the tab and the end panel suitable for finger access by a user. As described for mechanism 1, the inclination referred to is measured relative to the horizontal plane generally defined by the can end. As for mechanism 1, this aspect of the invention takes advantage of the natural curvature that a concave/convex protrusion possesses and the full or partial reversal in inclination that it will undergo when changing between concave and convex states. Mounting the tab on the inclined region of the moveable portion, and the reversal in inclination that occurs on transformation from first "concave" to second "convex" states provides an efficient mechanism for providing finger access under the tab. Summarising again, mounting the tab in this manner means that for a tab of a given length, the present invention requires a moveable portion of a smaller area than that of the finger well of U.S. Pat. No. 7,168,586B2 to provide the same gap under the handle of the tab. This provides benefits in terms of ease of manufacture because less forming operations are required.

For the can ends of U.S. Pat. No. 7,168,586B2, if positive pressure within a container incorporating the can end were to exceed too high a level, the protrusion would revert from its downward (finger access) state to its upward state, thereby destroying tab access. In contrast, for the can end of this alternative embodiment of the invention, anything which acts to urge the moveable portion into its upward state is a good thing, because the upward state of the invention provides finger access under the tab. Positive pressure may be induced during filling and retort processing. Alternatively, positive pressure may be induced by deforming the base and/or the sidewall of a container incorporating the can end to reduce the volume enclosed within the container. As a further alternative, when the can end of the invention is used for containers intended for carbonated beverages, the pressure from the carbonated beverage may act to induce sufficient positive pressure to cause the moveable portion to transform into its second (finger access) state. As this positive pressure would be sustained until the container is opened, this would permit a mono-stable panel to be used for the moveable portion.

Mechanism 3

In a further alternative aspect of the invention, the moveable portion is deformable in a see-saw rocking manner between first and second states to thereby displace the handle of the tab away from the end panel to define a gap between the handle of the tab and the end panel suitable for finger access by a user.

For either of mechanisms 1 or 2, the convex/concave profile of moveable portion referred to above can be achieved by pressing or stamping the end panel of the can end to thereby plastically deform the material of the can end to form the moveable portion with the convex/concave profile. In this way, the moveable portion may form an integral part of the end panel of the can end. The advantage of such a convex/concave profile is that it provides inherent bistability. This inherent bistability is provided because the distance measured along the convex/concave surface of the moveable portion from one point to another is greater than the linear distance between these two points. Consequently, the moveable portion has to be "squeezed" through a smaller gap in order to revert to and fro between first and second states, therefore requiring a force to induce this change.

For the avoidance of doubt, by "convex" and "concave" is meant not only where the moveable portion defines a perfect convex or concave curved profile; for example, like the element of a camera lens. Rather, it also includes where the trend-line generally defined by the profile of the moveable portion is convex or concave. For example, the moveable portion may include one or more annular beads; however, if the trend-line generally defined by the moveable portion is convex or concave, then it would still fall within the meaning of convex and concave for the purpose of the present invention.

BRIEF DESCRIPTION OF FIGURES IN THE DRAWINGS

Three preferred embodiments of the present invention are described below, with reference to the following drawings.

Figure 2:
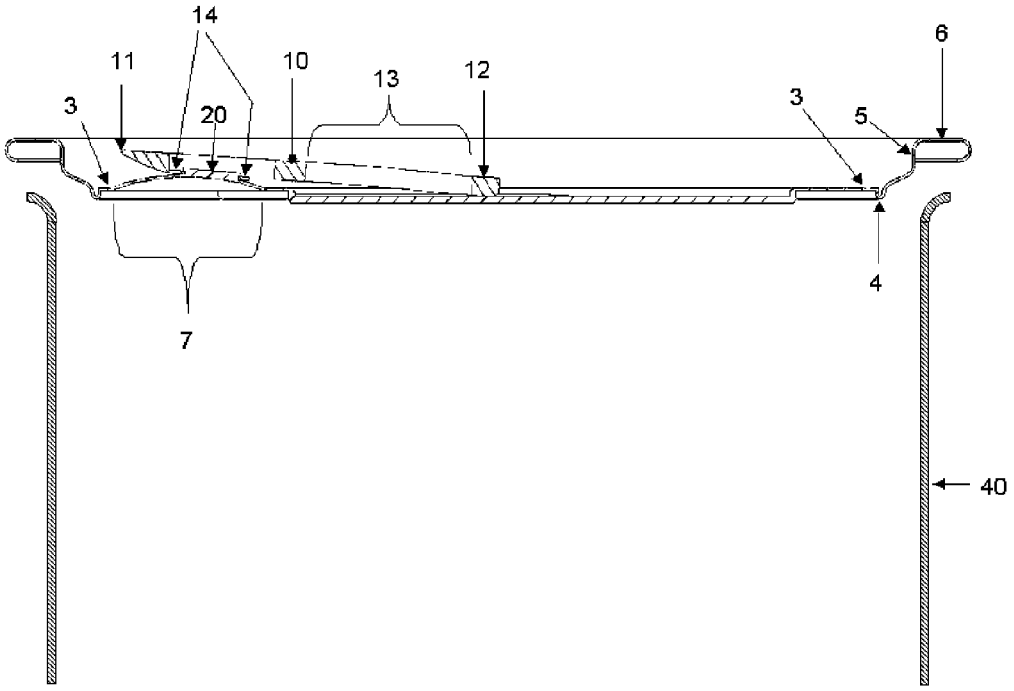
FIG. 2 is a view through section A-A of FIG. 1, showing the can end in its first "convex" state when located above the access opening of a container body.
Figure 3:
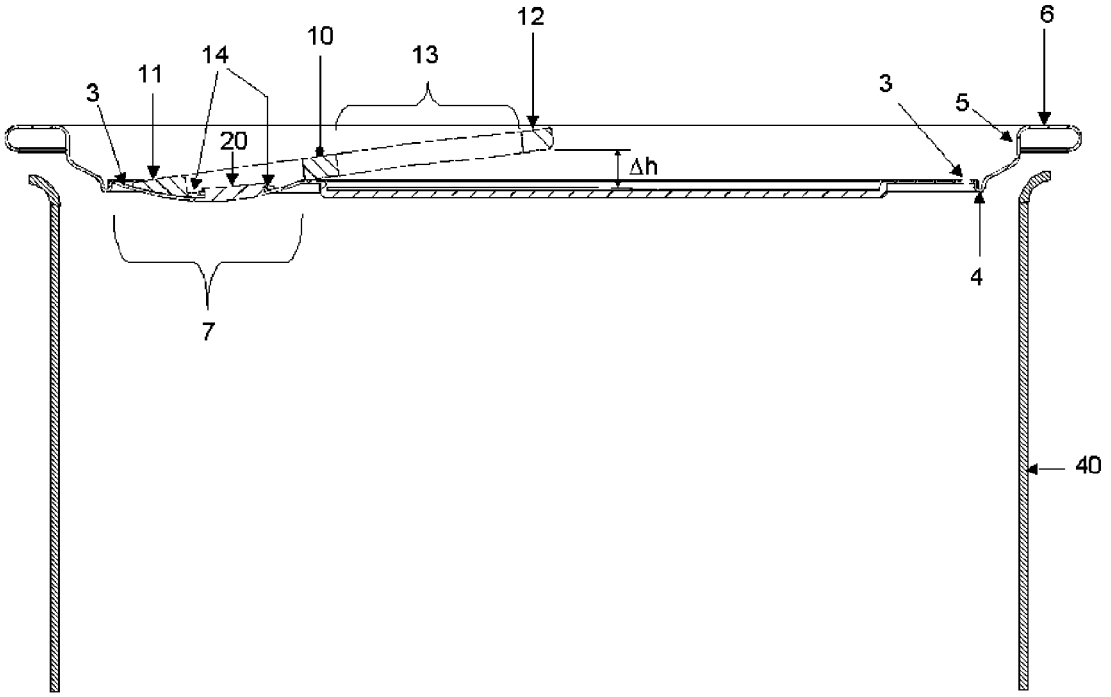

FIG. 3 corresponds to FIG. 2, but now showing the can end in its second "concave" (finger access) state.

Figure 4:
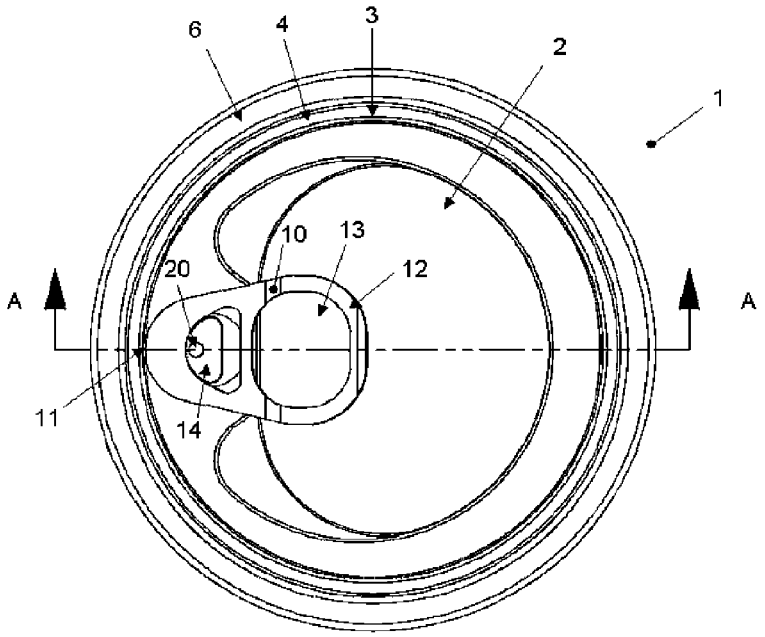

FIG. 4 is a plan view of a can end according to a second embodiment of the present invention.

Figure 5:
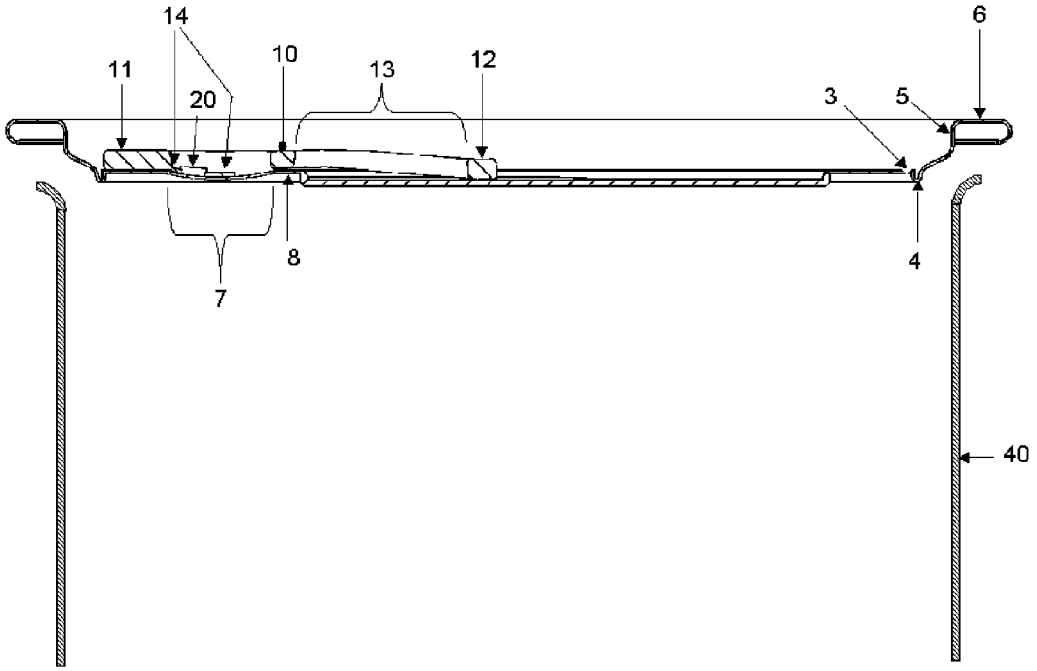

FIG. 5 is a view through section A-A of FIG. 4, showing the can end in its first "concave" state when located relative to the access opening of a can body.

Figure 6:
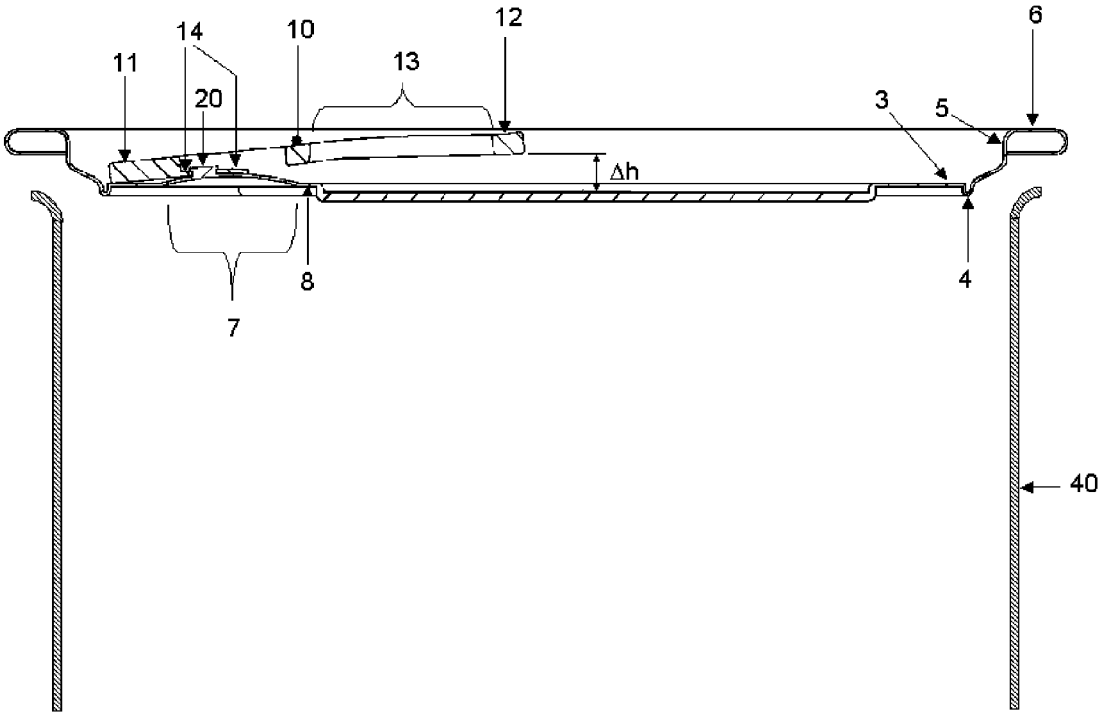

FIG. 6 corresponds to FIG. 5, but now showing the can end in its second "convex" (finger access) state.

Figure 7:
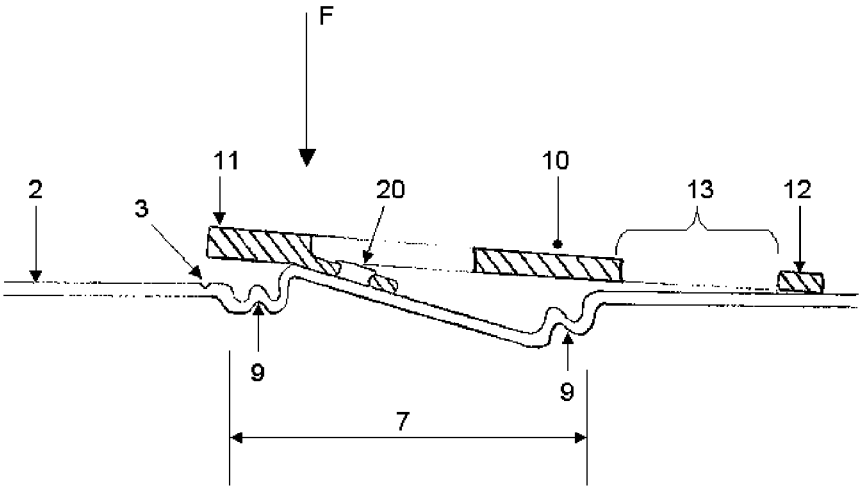

FIG. 7 is a detail cross-section view of part of a can end according to a third embodiment of the present invention, showing the can end in a first state.

Figure 8:
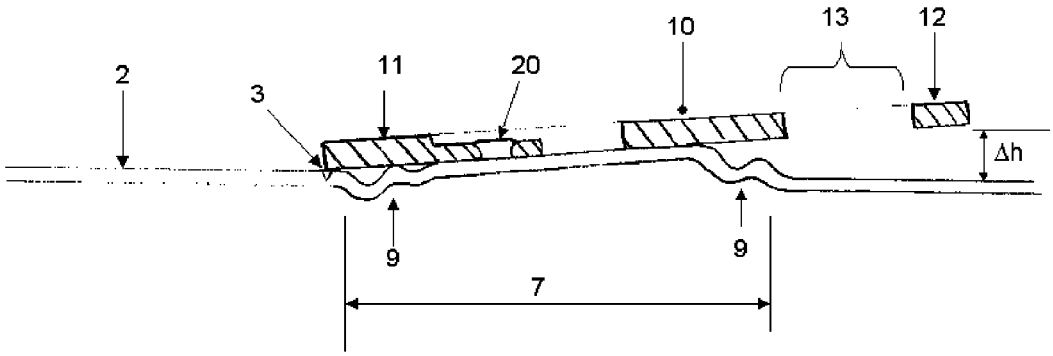

FIG. 8 is a detail view corresponding to FIG. 7, but instead showing the can end in a second (finger access) state.

MODE(S) FOR CARRYING OUT THE INVENTION

Figure 1:
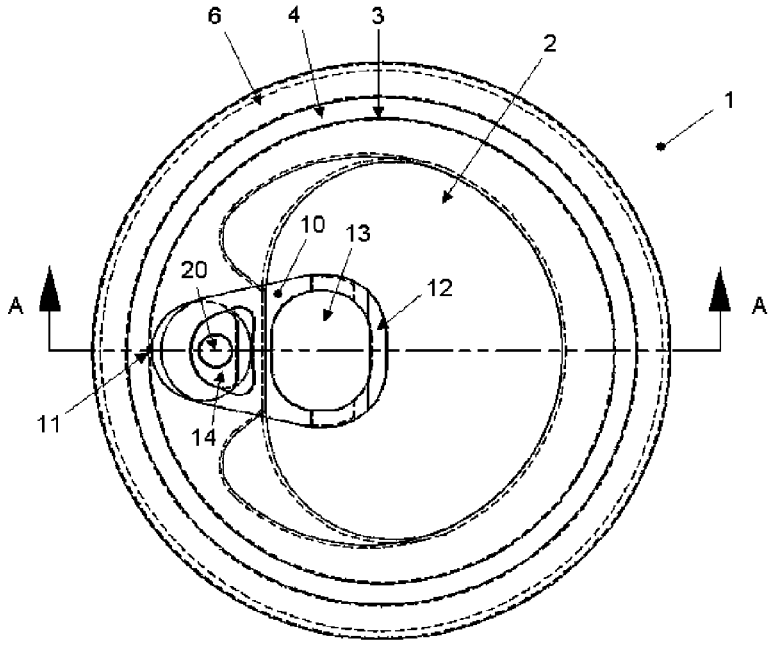
FIG. 1 is a plan view of a can end according to a first embodiment of the present invention.

A first embodiment of the invention is shown in FIGS. 1 to 3 and corresponds generally to "Mechanism 1" described above.

Can end 1 includes an end panel 2 provided with a score line 3 (see FIG. 1). The score line 3 extends continuously about the periphery of the end panel 2 to define a prearranged opening area (in this case, a "full-aperture"). In the embodiment illustrated, the whole of the end panel 2 inwards of the score line is removable from the can end 1. However, in an alternative embodiment, the score line 3 may not be continuous and the portion of the end panel 2 inwards of the score line 3 is retained by the can end; for example, as found on many beverage can ends.

Returning to the embodiment of FIGS. 1 to 3, the end panel 2 includes a countersink 4 located radially outwards of the score line 3 (see FIGS. 2 & 3). A chuck wall 5 extends first upwardly from the countersink 4, and then outwardly to define seaming panel 6 (see FIGS. 2 & 3). The seaming panel 6 enables the can end 1 to be fixed to the open end of a container body 40 by a conventional seaming process.

The end panel 2 includes an integral moveable portion 7 in the form of a bistable panel. In a first state (shown in FIG. 2), the moveable portion 7 defines a generally convex protrusion which protrudes upwardly from the end panel 2. In a second state (shown in FIG. 3), the moveable portion 7 defines a generally concave protrusion which protrudes downwardly from the end panel 2. The moveable portion 7 provides a mounting location for tab 10.

The tab 10 includes a nose 11 and a handle 12 (see FIG. 1). The handle 12 includes a ring section 13 suitable for a user to engage their finger. The tab 10 further includes a resiliently-formed tongue section 14 located between the nose 11 and the handle 12. The tab 10 is mounted on the moveable portion 7—via the tongue section 14—by a rivet 20. The tab 10 is mounted so that the nose 11 is located adjacent score line 3. As can be seen in FIG. 2, the tab 10 is mounted on an inclined region of the moveable portion 7 such that in the first state, the handle 12 of the tab is biased against and inclined towards the end panel 2 to define a zero or minimal gap between the handle and the end panel. As explained in the general description, prior to being fixed to container body 40, the can ends 1 would be transported in the state shown in FIG. 1, one stacked upon the other. In this first state, the biasing of the handle 12 of the tab 10 against the end panel helps to avoid adjacent can ends or foreign objects becoming locked under the tab.

To provide a user with finger access under the handle 12 of the tab 10, the moveable portion 7 must be moved from its first convex state to the second concave state shown in FIG. 3. This requires a downwards force to be applied to the moveable portion 7 in order to cause the bistable panel construction of the moveable portion to change from one stable state to the other. The downwards force may be applied by, for example, use of a mechanical punch (not shown). Alternatively, negative pressure may be used to suck the moveable portion 7 into its second concave state. The negative pressure may be achieved through seaming the can end 1 to a container body 40 filled with heated product, with the cooling of the product to ambient temperature naturally resulting in negative pressure within the sealed container (e.g. for food products).

Transformation of the moveable portion 7 into its second concave state has the effect of reversing the curvature of the moveable portion (including the tab's mounting location) relative to that of its first convex state. This transformation thereby results in the handle 12 of the tab being inclined away from the end panel to define gap Δh under the handle (see FIG. 3).

The can end shown is manufactured from 0.21 mm gauge, double-reduced (DR) tinplate to material specification DR550N. However, other materials providing sufficient strength/rigidity may be used instead.

A second embodiment of the invention is shown in FIGS. 4 to 6 and corresponds to "Mechanism 2" described above. Comparing to the first embodiment of FIGS. 1 to 3, like features are designated with the same reference numbers.

In contrast with the embodiment of FIGS. 1 to 3, the can end 1 of FIGS. 4 to 6 has a first state in which the moveable portion 7 defines a generally concave protrusion which protrudes downwardly from the can end. As for the first embodiment, the tab 10 is mounted on the moveable portion 7—via the tongue section 14—by means of rivet 20. As can be seen in FIG. 5, the tab 10 is mounted on an inclined region of the moveable portion 7 such that in the first state, the handle 12 of the tab is biased against the end panel 2 to define a zero or minimal gap between the handle and the end panel. The can ends 1 would be transported in the state shown in FIG. 5, one stacked upon the other. As for the first embodiment, the biasing of the handle 12 of the tab 10 against the end panel 2 helps to avoid adjacent can ends or foreign objects becoming locked under the tab.

The moveable portion 7 is provided on an elevated platform 8, such that in this first concave state, the moveable portion does not extend below the lowermost plane of the can end 1. This has the advantage of improving stackability of one can end upon another.

To provide a user with finger access under the handle 12 of the tab 10, the moveable portion 7 must be moved from its first concave state to the second convex state shown in FIG. 6. This requires an upwards force to be applied to the moveable portion 7. The upwards force may be achieved by, for example, inducing positive pressure within the container as described above in the general description of the invention.

Transformation of the moveable portion 7 into its second convex state has the effect of reversing the curvature of the moveable portion relative to that of its first concave state. This transformation thereby results in the handle 12 of the tab 10 being inclined away from the end panel to define gap Δh under the handle (see FIG. 6).

A third embodiment of the present invention is shown in FIGS. 7 & 8. In common with the first and second embodiments, like features are identified with the same reference numbers. FIGS. 7 & 8 are detail cross-sectional views of part of the can end 1—concentrated on moveable portion 7 and tab 10. A continuous corrugated transition region 9 links the moveable portion 7 to the remainder of the end panel 2. As shown in FIG. 7, the can end has a first state in which the moveable portion 7 is inclined in one sense to thereby bias the tab handle 12 against the end panel 2. However, on application of a downwardly applied force F to the movable portion (see FIG. 7), the moveable portion 7 flips in a see-saw rocking manner—enabled by the corrugated transition region 9—to adopt a second state as shown in FIG. 8. The rocking & flipping action of the moveable portion 7 causes the tab handle 12 to be displaced and inclined away from the end panel 2, thereby providing a gap Δh under the handle for finger access by a user.

The invention claimed is:

1. An easily openable can end comprising:

an end panel, the end panel having a score line formed therein that defines an opening area, the end panel further comprising a moveable portion, the moveable portion having a first state, whereby at least part of the moveable portion is convex, and a second state, whereby at least part of the moveable portion is concave, a tab having a nose and a handle, the tab mounted to the end panel by a rivet disposed on the moveable portion, wherein when the moveable portion moves from the first state to the second state, the handle of the tab moves away from the end panel and defines a gap (Δh) between the handle of the tab and the end panel suitable for finger access by a user.

2. An easily openable can end as claimed in claim 1, wherein in the first state, the handle of the tab is biased against the end panel.

3. An easily openable can end as claimed in claim 2, wherein the tab includes a resiliently formed tongue section, the tab mounted on the moveable portion via the tongue section to bias the handle of the tab against the end panel in the first state.

4. An easily openable can end as claimed in claim 1, wherein the moveable portion comprises a bistable panel.

5. An easily openable can end as claimed in claim 1, wherein the moveable portion is deformable in a see-saw rocking manner between the first and second states to thereby displace the handle of the tab away from the end panel and define the gap (Δh).

6. An easily openable can end as claimed in claim 1, wherein the moveable portion moves from the first state to the second state in a generally downwards motion.

7. An easily openable can end as claimed in claim 6, wherein the moveable portion is formed such that:

i. in the first state, the moveable portion protrudes upwardly from the end panel; and ii. in the second state, the moveable portion protrudes downwardly from the end panel.

8. An easily openable can end as claimed in claim 7, wherein the moveable portion is formed as a generally convex protrusion and a generally concave well in first and second states respectively.

9. An easily openable can end as claimed in claim 8, wherein the tab is mounted on an inclined region of the moveable portion such that when occupying the first state, which is a convex state, the tab handle is inclined towards the end panel, and when occupying the second state, which is a concave state, the tab handle is inclined upwardly away from the end panel to thereby provide the gap (Δh) between the handle of the tab and the end panel.

10. An easily openable can end as claimed in claim 1, wherein the transition from first to second states is by a generally upwards motion of the moveable portion.

11. An easily openable can end as claimed in claim 10, wherein the moveable portion is formed such that:

i. in the first state, the moveable portion protrudes downwardly from the end panel;

and ii. in the second state, the moveable portion protrudes upwardly from the end panel.

12. An easily openable can end as claimed in claim 11, wherein the moveable portion is formed as a generally concave well and a generally convex protrusion in first and second states respectively.

13. An easily openable can end as claimed in claim 12, wherein the tab is mounted on an inclined region of the moveable portion such that when occupying the first "concave" state, the tab handle is inclined towards the end panel, with transformation to the second "convex" state inclining the tab handle upwardly away from the end panel to thereby provide the gap (Δh) between the handle of the tab and the end panel suitable for finger access by a user.

14. An easily openable can end as claimed in claim 1, wherein the moveable portion is provided on a platform elevated relative to the remainder of the end panel such that in the first state, a lowermost point of the moveable portion does not extend below a lowermost plane of the can end, thereby enhancing stackability of the can end.

15. A container comprising a can end and a container body, the can end including:

an end panel, the end panel having a score line formed therein that defines an opening area, the end panel further comprising a moveable portion, the moveable portion having a first state, whereby at least part of the moveable portion is convex, and a second state, whereby at least part of the moveable portion is concave, a tab having a nose and a handle, the tab mounted to the end panel by a rivet disposed on the moveable portion, wherein when the moveable portion moves from the first state to the second state, the handle of the tab moves away from the end panel and defines a gap (Δh) between the handle of the tab and the end panel suitable for finger access by a user.

16. A container as claimed in claim 15, wherein in the first state, the handle of the tab is biased against the end panel.

17. A container as claimed in claim 16, wherein the tab includes a resiliently formed tongue section, the tab mounted on the moveable portion via the tongue section to bias the handle of the tab against the end panel in the first state.

18. A container as claimed in claim 15, wherein the moveable portion comprises a bistable panel.

19. A container as claimed in claim 15, wherein the moveable portion is deformable in a see-saw rocking manner between the first and second states to thereby displace the handle of the tab away from the end panel and define the gap (Δh).

20. A container as claimed in claim 15, wherein the moveable portion moves from the first state to the second state in a generally downwards motion.

21. A container as claimed in claim 20, wherein the moveable portion is formed such that:

i. in the first state, the moveable portion protrudes upwardly from the end panel; and ii. in the second state, the moveable portion protrudes downwardly from the end panel.

22. A container as claimed in claim 21, wherein the moveable portion is formed as a generally convex protrusion and a generally concave well in first and second states respectively.

23. A container as claimed in claim 22, wherein the tab is mounted on an inclined region of the moveable portion such that when occupying the first state, which is a convex state, the tab handle is inclined towards the end panel, and when occupying the second state, which is a concave state, the tab handle is inclined upwardly away from the end panel to thereby provide the gap (Δh) between the handle of the tab and the end panel.

24. A container as claimed in claim 15, wherein the transition from first to second states is by a generally upwards motion of the moveable portion.

25. A container as claimed in claim 24, wherein the moveable portion is formed such that:

i. in the first state, the moveable portion protrudes downwardly from the end panel; and ii. in the second state, the moveable portion protrudes upwardly from the end panel.

26. A container as claimed in claim 25, wherein the moveable portion is formed as a generally concave well and a generally convex protrusion in first and second states respectively.

27. A container as claimed in claim 26, wherein the tab is mounted on an inclined region of the moveable portion such that when occupying the first "concave" state, the tab handle is inclined towards the end panel, with transformation to the second "convex" state inclining the tab handle upwardly away from the end panel to thereby provide the gap (Δh) between the handle of the tab and the end panel suitable for finger access by a user.

* * * * *